United States Patent [19]

Metso

[11] Patent Number: 4,610,200

[45] Date of Patent: Sep. 9, 1986

[54] ARRANGEMENT IN SILK SCREEN PRINTERS FOR POSITIONING A SECOND PATTERN DERIVING FROM A FIRST PATTERN LOCATED ON A STENCIL IN RELATIONSHIP WITH AN INTENDED LOCATION ON MATERIAL TO BE PRINTED

[76] Inventor: Matti Metso, Skyttevägen 15., 13400 Gustafsberg, Sweden

[21] Appl. No.: 786,120

[22] Filed: Oct. 10, 1985

[30] Foreign Application Priority Data

Oct. 10, 1984 [SE] Sweden ..... 8405067

[51] Int. Cl.[4] ..... B41L 13/02

[52] U.S. Cl. ..... 101/126; 364/518; 364/167

[58] Field of Search ..... 101/114, 126, 128.4, 101/129, DIG. 12; 364/518, 167

[56] References Cited

U.S. PATENT DOCUMENTS

| | | | |
|---|---|---|---|
| 3,941,053 | 3/1976 | Black et al. | 101/126 X |
| 3,948,170 | 4/1976 | Ericcson | 101/126 X |
| 4,203,360 | 5/1980 | Madwed | 101/129 |
| 4,226,181 | 10/1980 | Ericcson | 101/129 |
| 4,242,957 | 1/1981 | Mascioni et al. | 101/126 X |
| 4,404,903 | 9/1983 | Cronin | 101/126 |
| 4,469,022 | 9/1984 | Meador | 101/126 |
| 4,516,495 | 5/1985 | Ericcson | 101/129 |

*Primary Examiner*—E. H. Eickholt

*Attorney, Agent, or Firm*—Burns, Doane, Swecker & Mathis

[57] ABSTRACT

An arrangement in a silkscreen printer for positioning a second pattern (4*b*) deriving from a first pattern (4*a*) provided on a stencil (4) in relation to material (2) to be printed while using a first memory arranged to store data relating to the desired position of the second pattern in relation to a reference point. The material (2) on to which the second pattern (4*b*) is to be printed is displaced to a printing position, in which means (5, 5') are arranged to evaluate the true position of the material. In addition means are provided for evaluating the discrepancy which would occur if the second pattern (4*b*) were to be applied to the material (2) in its present position. Any deviation between the true position and the desired position is evaluated and when a deviation is found to exist a stencil-holding frame (3) and/or a printing table and/or the material is, or are, displaced, or brought in some other way to a position determined by the magnitude and directional sense of the deviation, so that when applying the first pattern (4*a*) to the material (2) the transfer pattern (4*b*) is printed on the material in a position in which full or satisfactory compensation has been made for the previously established deviation. The position of the material can be evaluated with the aid of index marks (2') or part of a previously printed pattern. The position of the material (2) and/or its pattern is, or are, evaluated with the aid of one or more optical scanning and sensing means (5,5'), preferably evaluating the position of index marks. The scanning signals (5*a*) obtained from the optical scanning and sensing means (5) are fed to a first unit (34) which stores scanning signals for each line in real time. These scanning signals are evaluated by a processor (2) which restructures the signals to a different form, these restructured signals being stored in a second memory (35). A stencil frame (and/or material to be printed) is arranged for displacement by means of three stepping-motors or like devices, and evaluated and calculated displacement values for each of these stepping-motors are applied thereto simultaneously and/or substantially simultaneously.

10 Claims, 14 Drawing Figures

Fig 3.

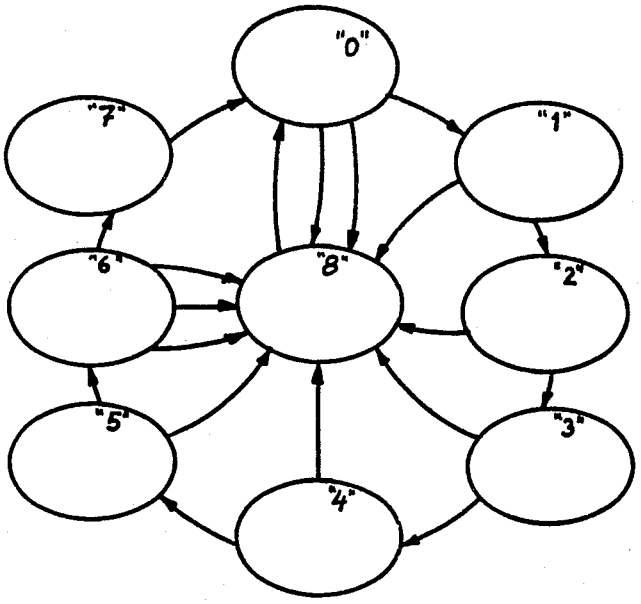

```
Format of Camera Data:
CAMERA x DATA:  ! STATUS0 !   N0    ! DATA1  ! DATA2  ! DATA3  ! DATA4
                ! DATAN0 ! STATUS1 !   N1   ! DATA1  ...... ! DATAN1 !
where  !     ! is 16 bit words
        Nx  is number of data words (= transitions of the line)

     STATUS  is a word described below

         0:  line is not read
         1:  this line is ready for processing
         2:  NEW CYCLE timeout
         3:  lost line due to overrun
         4:  CAMERA DATA overflow
         5:  PROC COMPL  timeout
         6:  PROC COMPL  timeout
         9:  last line, image ready for processing

DATAn  has the format:
         D0.. D11  : length of light/dark field
         D12.. D14 : ignorable
         D15       : light/dark
```

Fig 4.

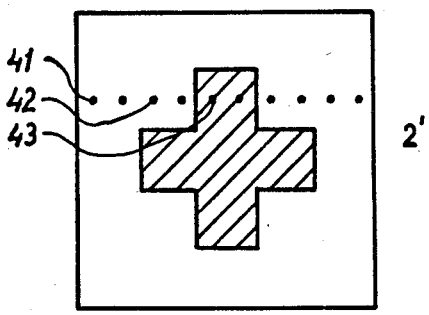

Fig 6.

```
166  3  CALL MAKE A LINE;
167  3  IF T=0 /*NO CONTRIBUTION*/
168  3  THEN DO;
169  4         IF MTOT  MMIN /* THE WHOLE CIRCLE IS FOUND*/
170  4         THEN DO;
171  5               LAST_LINE = 1
172  5            END;
173  4         ELSE DO; /*WHAT WAS FOUND WAS NOT
                          THE CIRCLE */
174  5            XPROD, YPROD, MTOT = 0;
175  5          END;
176  4       END;
177  3  ELSE DO; /*CONTRIBUTION TO CIRCLE*/
178  4      XPROD=XPROD+(2*2+T)*T;    /*Z=POS OF FIRST TRANS.*/
179  4      YPROD=YPROD+2*LINENUMBER*T    /* T=LENGTH AFTER TRANS. */
180  4      MTOT=MTOT+T;
181  4     END;
182  3  IF NUMB >3  THEN PICTURE_ERROR=11
184  3  LINENUMBER=LINENUMBER+1;
185  3  LINEP=LINEP+2*LINE.N+4   ;
186  3  END;
```

Fig 7.

```
195  1  GET INDEX 1;
        PROCEDURE PUBLIC;
196  2  IF CAL PROC <> 0  THEN CALIB=0;
198  2  CALL INDEX CALC(.CAMERA_1_DATA);
199  2  IF MTOT <> 0
200  2  THEN DO;
201  3         TPX1=200-(YPROD/MTOT);
202  3         TPY1=200-(XPROD/MTOT);
203  3        END;
204  2  ELSE IF PICTURE ERROR=0 THEN PICTURE ERROR=18;
206  2        IF PICTURE_TRACE=1  THEN INDEXT_MESS=1;
208  2  END
        GET_INDEX_1;
```

Fig 8.

```
------------------------DISPLACEMENT CALCULATION----------------

        Calculate displacement relative to last SETUP values.
        *1
60  2  X1=INT((TPX1-CX1)*PIXEL_1);
61  2  Y1=INT((TPY1-CY1)*PIXEL_1);
62  2  X2=INT((TPX2-CX2)*PIXEL_2);
63  2  Y2=INT((TPY2-CY2)*PIXEL_2);
```

Fig 10.

```
------------------------X_DIFFERENCE IN RANGE?-------------------

        Check if distance between index marks in range  1
64  2 IF IABS(X1-X2)>X_TOLERANCE THEN CALC_ERROR=1;
      /* Take average if different */
66  2 XB=(X1+X2)/2;
```

Fig 11.

```
------------------------CALCULATE X-AXIS DISPLACEMENT--------------

        Calculate displacement for X-axis.
     */
67  2  IF X_ENABLE <>0  then do;
69  3    IF(XB>0)/* The index marks to right from
                    the SETUP position */ THEN
70  3              MX1,MX2=INT(KXT*UNSIGN(  XB)/SCALE);
71  3          ELSE
                   MX1,MX2=INT(KXT*UNSIGN(-BX)/SCALE);
72  3  END;
```

Fig 12.

```
------------------------CALCULATE NUMBER OF STEPS FOR RUN----------

       Check if the left side index mark above the SETUP position
       if it is - add difference to MX1 motor and substract from MX2.
    */
73  2   ANGLE:DO;
74  3  IF TURN_ENABLE<>0  THEN DO;
76  4     IF (Y1>Y2)
77  4      THEN DO;
78  5         Mx1=MX1-INT((KX1R*UNSIGN(Y1-Y2))/SCALE);
79  5         MX2=MX2+INT((KX1R*UNSIGN(Y1-Y2))/SCALE);
80  5      END;
81  4    ELSE DO;
82  5         MX1=MX1+INT((KX1R*UNSIGN(Y1-Y2))/SCALE);
83  5         MX2=MX2-INT((KX1R*UNSIGN(Y2-Y1))/SCALE);
84  5    END;
85  4  END;
86  3  END ANGLE;
       EJECT
```

Fig 13.

Fig 14.

```
            /* ----------------CALCULATE Y-AXIS DISPLACEMENT-----------

            Check if CAMERA 1 index mark above SETUP position -
            then set - direction for MZ motor.

            */
87  2  IF Y_ENABLE <> 0  THEN DO;
89  3    IF (Y1 > 0)  THEN
90  3              MY=INT(KY1T* UNSIGN( Y1)/ SCALE);
91  3               ELSE
                   MY=-INT(KY1T* UNSIGN(-Y1)/SCALE);

            /*

            Check if CAMERA 2 index mark above SETUP position-
            then set (-)direction for MZ motor
            */
92  3    IF (Y2 > 0) THEN
93  3              MY=MY+INT(KY2T* UNSIGN( Y2)/SCALE);
94  3              ELSE
                   MY=MY-INT(KY2T* UNSIGN(-Y2)/SCALE);
95  3  END;
```

ARRANGEMENT IN SILK SCREEN PRINTERS FOR POSITIONING A SECOND PATTERN DERIVING FROM A FIRST PATTERN LOCATED ON A STENCIL IN RELATIONSHIP WITH AN INTENDED LOCATION ON MATERIAL TO BE PRINTED

TECHNICAL FIELD

The present invention relates to an arrangement in silk screen printers for positioning a second pattern, or printed pattern, deriving from a first pattern, or master pattern, provided on a stencil, in relation to material to be printed.

An arrangement according to the invention incorporates a first memory in which the desired position of the printed pattern in relation to a reference point is stored. The material on to which the first or master pattern is transferred can be moved to a printing station and aligned therein, means being provided for evaluating the true position of the material in its position of alignment. The arrangement also includes means operative to evaluate those positional discrepancies which might occur should the master pattern be transferred to the material in the present mutual pattern/material alignment. In the event of a discrepancy between the actual relative position of the mastern pattern and the desired position of the printed pattern on the material, the stencil frame and/or a printing table and/or solely the material to be printed is, or are, displaced in directions and to extents commensurate with the discrepancy, or brought to the desired position in some other way, so that the printed pattern is printed on the material in precisely the position intended. The position of the material in relation to the stencil frame can be established with the aid of alignment or index markings on the material, or may be established with the aid of part of a previously printed pattern.

BACKGROUND PRIOR ART

Various methods and apparatus for positioning the master pattern in relation to the desired location of a printed or transfer pattern on material to be printed are known to be art.

For example, there is described in U.S. Pat. No. 4,226,181 a method and apparatus for adjusting the position of a stencil in relation to a printing table, according to which method:

(a) A transparent material is placed on the printing table, over a reference pattern;

(b) The stencil master pattern is transferred to the transparent material, through a printing process;

(c) Any deviation between the printed pattern and the reference pattern is compensated for and eliminated by displacing the printed transparent material in a manner to cause the printed pattern to coincide with the reference pattern;

(d) The positions of the stencil and the stencil frame are adjusted in precisely the same manner as the position of the transparent material.

A development of the method and apparatus described in the aforesaid U.S. Pat. Specification is described in Swedish Patent Application No. 7903516-8 (corresponding to U.S. Pat. No. 4,485,447), this further development relating to adjustment of print applied to material by means of a printing machine, so that the print coincides substantially with a reference pattern.

The method described in this prior Patent Application comprises (a) Positioning a reference pattern, serving as a master pattern, on an alignment table separate from the printing table and creating a first reference pattern alignment means corresponded by second alignment or index means on the printing machine;

(b) Scanning the reference pattern formed on the master pattern to establish pre-determined markings, using at least one scanning and sensing means;

(c) Reading the positional values of the markings obtained with the aid of at least one scanning and sensing means;

(d) Applying print in the printing machine to material registered therein with the aid of the second alignment or index means;

(e) Bringing the material printed in accordance with (d) into register with the first aligning means on the alignment table;

(f) Scanning the material printed according to (d) and reading markings on the print corresponding to the pre-determined markings on the reference pattern, using to this end at least one scanning and sensing means;

(g) Reading the positional references of the markings on the print obtained from at least one scanning and sensing means;

(h) Comparing the positional references established in accordance with steps (c) and (g);

(i) Establishing each deviation between the markings of the reference pattern and the print with respect to its numerical values and directional sense;

(j) Establishing displacement values suitable for rectifying this deviation and for applying subsequent print to further material substantially precisely in relation to the reference pattern;

(k) Establishing the displacement values which need to be applied to a number of positioning means in order to compensate for this deviation.

The method according to German Offenlegungsschriften No. 3 027 717 for guiding a printing arrangement with the aid of individually controllable means also forms part of the pertinent prior art.

SUMMARY OF THE PRESENT INVENTION

TECHNICAL PROBLEM

In the case of a Silkscreen printer relating to the aforesaid technical field to which the invention pertains, and in particular with respect to the fulfilment of high-speed printing requirements, there exists a qualified technical problem in enabling the following sequence of events to be carried out within a given time period of a machine cycle, normally within a period of less than 0.2 seconds:

Establishment of the true position of the material to be printed, including small tolerances (less than 0.1 mm) when the material occupies its registered or aligned position in a printing station (on a printing table), by sensing the position of an index mark or a significant part of a previously printed pattern.

Determination of the position of the aligned index mark in relation to a fixed reference, normally a location on the frame structure of the silkscreen printer.

Conversion of data relating to the configuration of the index mark and obtained in time sequence.

Application of measures for deriving from this sequential data unequivocal information relating to the true position of the index mark and its configuration.

Establishment of the center of gravity of the index mark.

Comparison of calculated x and y co-ordinates of the center of gravity of the index mark with previously stored co-ordinate reference values.

Establishment of possible deviations between the center of gravity of the index mark and the stored co-ordinate values with respect to magnitude and direction.

Calculation of the composite motion required of a plurality of stepping-drive motors, normally three in number, in order to compensate for the established deviation and to move either the material or the stencil to a desired position.

A necessary effectuation of similar compensation with respect to a discrepancy or deviation in which the distance between two index marks differs from the same distance for the stored co-ordinate values.

Provision to the stepping-motors of control signals produced in reponse to calculations carried out while observing possible compensation.

Another technical problem in this art is one of providing simple means which enable the requisite values to be calculated and simultaneously, or substantially simultaneously, applied to all stepping-motors.

The problem of achieving these solutions becomes even more difficult technically when considering the fact that positioning of the index mark must be determined with the aid of an extremely large quantity of data obtained by scanning the index mark and reading the image obtained line for line, and that this wealth of information must be processed and evaluated in real time, which means that the processor herefore must be switched between different data-processing modes in order to process this information.

The technical problems involved are rendered still more difficult by the fact that the adjustments to the positional settings of the stepping-motors driving the stencil frame or the like in response to the calculated values must also be made within the space of the time available.

A further technical problem in this particular technical field is one of providing ways and means whereby, within the span of a normal working cycle of a silkscreen printer, a camera scanning unit can be introduced between the material to be printed and the stencil with the material in its position of alignment; the true position of the index mark can be sensed and established in the time available; and the scanning unit can be removed, calculations made with respect to the extent to which stencil and/or material require positional adjustment; and corresponding actuation of the stepping-motors before initiation of a printing sequence.

It will be understood that in view of the technical problems recited above, the time available for effecting the various computations in the processor is extremely short and hence a further qualified technical problem is one of providing means whereby instead of utilising the series of data received sequentially from the camera unit, this data signifying the position and configuration of the image, in the form obtained, the said series of data can be placed in a data format which will ensure rapid filtration of the configuration of the index mark, so that said mark is unambiguously defined and so that a simple computation can be made of the centroid point of the mark and the co-ordinates of this centroid point established.

SOLUTION

The present invention thus relates to an arrangement in silkscreen printers for bringing a first or master pattern located on a stencil into exact alignment with the intended location of the second pattern or printed pattern on material to be printed, for transfer of the master pattern on to the material at precisely the location desired, this arrangement comprising a first memory intended to store data relating to the desired position of the printed pattern in relation to a reference point. The material to which the master pattern is to be transferred shall be capable of being moved to a printing station in which means are arranged for establishing the true position of the material in said station. Means are also provided for establishing the possibility of positional discrepancies or deviations should the pattern be printed with the material in its present position. It is therewith established whether or not deviations between the actual position and desired position exist, and in the event that a deviation is found, means are activated to move the stencil frame and/or a printing table, and/or the material, to an adjusted position contingent on the magnitude of the deviation and its directional sense, or are brought to this adjusted position in some other way, so that when transferring the master pattern to the material the printed pattern is located in precisely the desired location, with the aforesaid deviation fully rectified. It is also possible to establish the position of the material with the aid of index marks or with the aid of part of a previously printed pattern.

In accordance with the present invention the stencil frame (and/or the material to be printed) is, or are, displaceable with the aid of three stepping-motors or like devices, and signals corresponding to the established and calculated extent to which each motor shall displace the stencil frame and/or the material are fed to the motors simultaneously, or substantially simultaneously, for a simultaneous activation of the motors to their displacing mode. In accordance with one advantageous embodiment of the invention the position of the materials and/or its pattern is established with the aid of one or more optical scanners, preferably adapted to establish the position of index marks, the scan signals produced by the optical scanning means being fed to a first storage unit for storing the scan signals for each line in real time, these scan signals being restructured in a processor and stored in their restructured form in a second storage unit.

Conveniently, in conjunction with restructuring the scan signals there is fed to the second storage unit information which comprises solely status information, the number of transitions, and the positions at which the scan image passes from white to black and black to white.

The scan signals deriving from a complete image and obtained from a first optical scanning unit are preferably first fed to the scan unit and then restructured for storage in the second storage unit, whereafter scan signals for a complete image obtained from a second optical scan unit are first fed to the unit and then restructured for storage in the second storage unit.

It is also proposed to integrate the first and secon stores, so that in principle the stores comprise one and the same storage unit with allocated memory sites.

According to a further advantageous embodiment of the invention the index mark is illuminated by means of fibre optics located adjacent to the optic or sensing means. In addition, the optical scanning and sensing means is suitably adapted to evaluate from the index mark a surface area which is smaller than a pre-determined maximum surface area, a surface area which is larger than a minimum surface area, and an unequivocably defined contour in order to be accepted for calculation of the x and y co-ordinates of the centroid point.

The image obtained from the optical sensing and scanning means is preferably restructured so as to orientate the x and y co-ordinates to a reference co-ordinate system.

Finally, there is also preferably included a programme instruction for establishing a stepping-motor movement in the direction of the x-axis, a programme instruction for establishing a stepping-motor movement in the direction of the y-axis, and a programme instruction for establishing combined stepping-motor movement to produce a rotational effect. These evaluated movements of the stepping-motors are added together and applied to all stepping-motors simultaneously, for simultaneous displacement movements.

ADVANTAGES

Those advantages primarily characteristic of an arrangement according to the present invention reside in the provision of conditions which enable the magnitude and directional sense of adjustments required of the stepping-motors in order to charge the position of the pattern to be printed on the material in a manner which ensures that this pattern is located precisely or substantially precisely in relation to a desired position to be established in real time with respect to the normal working cycle of the printing machine.

The primary characteristic features of an arrangement according to the invention are set forth in the characterising clause of the following claim 1.

BRIEF DESCRIPTION OF THE DRAWINGS

A proposed embodiment exhibiting features characteristic of the present invention will now be described in more detail with reference to the accompanying drawings, in which:

FIG. 3 is a constitutional diagram illustrating the processing of two index marks capable of being evaluated by optical sensing units.

FIG. 4 illustrates structural definitions of the information stored in the second store;

FIG. 6 is an enlarged view of an optical window with with but very few scanning points placed in a line and an index mark located in the centre of the window;

FIG. 7 illustrates a programme instruction lay-out intended for calculating the centroid point of an index mark;

FIG. 8 illustrates a programme instruction lay-out intended for restructuring scanned x and y co-ordinates.

FIG. 10 illustrates programming instructions intended for establishing deviations in stepping-motor feed within the camera window;

FIG. 11 illustrates programming instructions for placing a transfer print or second print centrally between previously evaluated index marks;

FIG. 12 illustrates programming instructions for determining desired stepping-motor displacement in the direction of the x-axis;

FIG. 13 illustrates programming instructions for determining desired co-ordinated stepping-motor movements for rotating a print in relation to the material;

FIG. 14 illustrates programming instructions for determining desired stepping-motor displacement in the direction of the y-axis.

DESCRIPTION OF AN EMBODIMENT AT PRESENT PREFERRED

Figure 1:
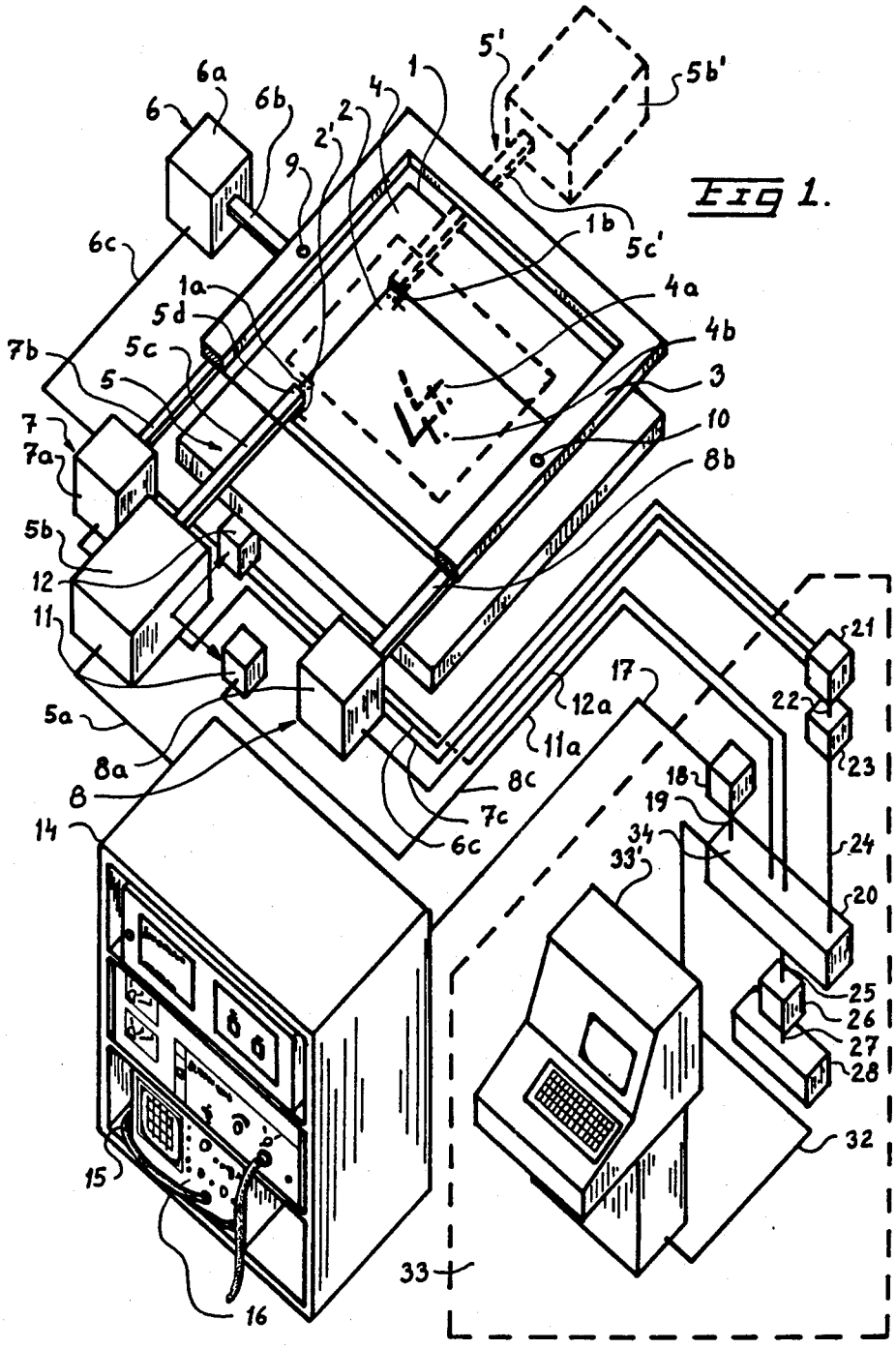
FIG. 1 illustrates in very simple fashion a silkscreen printer which is provided with means for establishing in a contactless manner, the position of material to be printed in relation to a stencil frame.

FIG. 1 is a perspective, greatly simplified view of a silkscreen printer which incorporates a printing table 1 onto which material 2 which is to be printed with a given pattern in a given location thereon is mounted and registered in a printing position or station with the aid of appropriate means not shown.

Located above the printing table 1 is the frame 3 having stretched thereon a stencil 4. The stencil 4 exhibits a first pattern, or master pattern, **4*a*, the pattern in this case being the numeral "4" and being shown in full lines. The master pattern to be transferred to the material 2 to provide a second pattern, or printed pattern, 4*b*, is transferred to the material with the aid of a reciprocatingly moveable squeegee arrangement not shown, the transfer or printed pattern being shown as the numeral 4 in broken lines. Because of the inherent elasticity of the stencil 4, the printed pattern 4*b* will deviate slightly from the master pattern 4*a*, and in order to eliminate this discrepancy in true reproduction it is necessary to adjust the position of the master pattern in relation to the material, so that the ultimate printed pattern will be located on the material 2** in precisely the position desired.

In addition to deviations resulting from the inherent elasticity of the stencil, deviations in the desired location of the printed pattern may also occur because the material 2 has been wrongly positioned on the printing table, despite the presence of registration means **1*a*, 1*b*** thereon, thereby requiring the possibility of adjusting the master pattern in relation to the said material, so that the printed pattern is located in precisely the desired position thereon.

The position of the material 2 on the printing table 1 is established by means of two optical scanning and printing units 5, 5', each of which is located on a respective opposite side of the printing table and adapted to scan and sense a respective index mark. The two units 5, 5' are mutually identical and hence only the unit 5 will be described in detail hereinafter.

Adjustments to the positional setting of the stencil-frame 3, in order to bring the master pattern **4*a* into correct relationship with the material 2, so that the printed pattern 4*b* is located correctly thereon, are effected with the aid of three frame-displacing devices 6, 7 and 8. To this end, the devices 6 and 7 are arranged to act upon a mutually common point 9 on the frame 3, whereas the device 8 is arranged to act on the frame at a point 10 thereon located directly opposite the point 9**.

The frame-displacing device 6 of this embodiment has the form of a stepping-motor 6*a* and an arm 6*b* which can be displaced axially with the aid of the motor 6*a* and which, in practice, has a longer length than the illustrated arm.

Similarly, the device 7 comprises a stepping-motor 7*a* and an arm 7*b* axially displaceable with the aid of the motor 7*a*, and the device 8 comprises a stepping-motor 8*a* and an arm 8*b* which can be displaced axially by means of the motor 8*a*.

It will be understood that adjustment to the position of the stencil frame constitutes only one of a number of possible positional adjustments which can be made and that the devices 6, 7 and 8 could be arranged to act discretely on the table and/or directly on the material 2.

The position to which the sensing unit 5 need be set in relation to the printing table 1, the stencil or the machine frame in order to carry out its scanning and sensing function is established with the aid of two position sensing devices 11 and 12. In the illustrated embodiment this setting position is evaluated in relation to the machine frame.

The scanning and sensing unit of this embodiment comprises a video camera 5*b* retailed by RETICON, U.S.A., under the designation MC521, an arm 5*c*, and an optical sensing means 5*d*. The camera is connected, via a transmission line 5*a*, to a control unit 14, to which there is sent an image of the index mark evaluated by the sensing means 5*d*, the control unit 14 being a unit retailed by RETICON under the designation RS 521.

The control unit 14 is connected by a transmission line 15 to a monitor in the form of an oscilloscope 16, and by a transmission line 17 to a signal converter 18, retailed by INTEL, USA under designation ICS 920.

The signal converter 18 is connected by means of a transmission line 19 to a central unit 20, which is described more fully hereinafter with reference to FIG. 2.

The stencil-frame displacing devices 6, 7, 8 are mutually identical and comprise stepping-motors retailed by MICRO-CONTROLE, Paris, France under designation UP 70-40.

Each of the devices, 6, 7, 8 is connected by a respective cable 6*c*, 7*c*, 8*c* to a power supply device 21 retailed by MICRO-CONTROLE under designation IP-28, this power supply device being connected through a cable 25 to an indexing unit 23, which is connected in turn to the central unit by means of a cable 22.

Each of the position sensing means 11 and 12 comprises an absolute coder retailed by LEINE & LINDE, Stockholm, Sweden, under designation 7306, and is connected to the central unit 20 by means of a respective line 11*a* and 12*a*.

The central unit 20 controls, via a line 25, a signal converter 26 which is similar to the signal converter 18 and which is connected by a line 27 to a programmeable control circuit 28, such circuits being necessary for the operation of all silkscreen printers. Since this control circuit is known per se and since all skilled in this art are aware of where signals significant to desired functions shall be applied in the circuit, no further description will be given of this particular circuit. The control circuits are normally adapted to the type of machine concerned.

It will be understood that the illustrated blocks 18, 20, 21, 23 and 26 comprise parts which are physically combined to form a complete control assembly, here reference 33, incorporated in a central control centre 33', and that in FIG. 1 these blocks have been illustrated as separate entities external of the control centre 33' merely for the sake of clarity.

Figure 2:
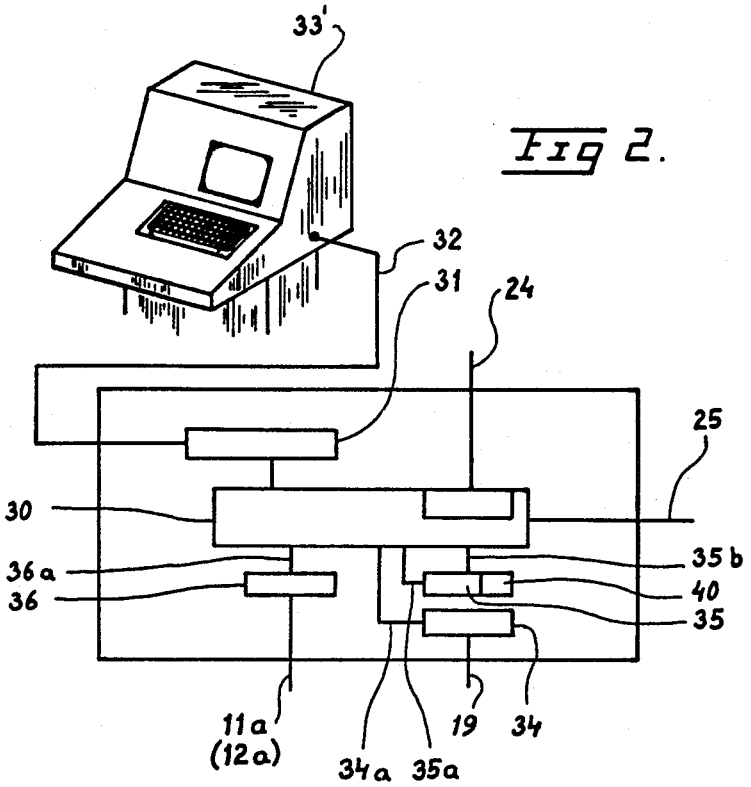
FIG. 2 is a block diagram illustrating the component members of a function control unit.

The central control unit 20 is shown in more detail in FIG. 2 and includes a computer or processor 30, retailed by INTEL, USA, under designation BC 88/25, a circuit 31 for controlling video signals sent to the processor 30 and connected by a line 32 to the control centre 33' provided with a button bank and a display device not referenced. The circuit 31 comprises a "Video Display Controller" retailed by INTEL under designation iSBC 270.

The line 19 is connected to an interface or memory store 34, retailed by RETIKON under designation RSB 6020, which in turn is connected to the processor 30 by a line 35*a* (processor bus). The processor can be placed in communication with a memory (35) of the kind retailed by ELECTRONIC SOLUTION, USA, under designation RAM/PROM-8C. via a line 35*a* (processor bus).

The second memory device 35 co-operates with the processor 30 via a line 35*b* (processor bus).

The memory device 35 incorporates a first memory facility 40 in which there is stored information relating to the x and y co-ordinate values of the centroid point, for example, of the index marks required to ensure that a pattern can be printed on the material at a predetermined location thereon, within permitted tolerances.

The transmission lines 11*a*, 12*a* are connected to an input module retailed by ELECTRONIC SOLUTION under designation SIM-64, this module in turn being connected to the processor 30 over a transmission line 36*a*.

FIG. 1 illustrates an arrangement in silkscreen printers for orienting a second, or transfer pattern 4*b* deriving from a first, or master pattern 4*a* in precise relationship with material 2 to be printed and/or to part of a pattern previously printed thereon. The material rests against the printing table 1 and is transported to and aligned in its intended position on the table with the aid of transporting means (not shown) and registration or alignment means 1*a*, 1*b*, this position of alignment having a permitted tolerance of less than 1 mm. The pattern 4*b* subsequently applied to the material 2 may not deviate from a given value or a given position on the material by more than 0.1 mm however and hence it is necessary to make adjustments in order to ensure that the printed pattern 4*b* deriving from the master pattern 4*a* on the stencil will be positioned on the material in a desired location within extremely narrow tolerances. These adjustments can be made when it is known just where the printed pattern will be located on the material if no measures are taken, this knowledge enabling establishment of the extent to which the stencil and/or material and/or the printing table need be moved in order for the subsequent printed pattern to be located in a desired position or placed on the material.

As before mentioned, the adjustments needed to ensure that the first pattern, or master pattern, will be transferred to the material 2 at precisely the desired location thereon, therewith to eliminate discrepancies between the master and printed patterns, the illustrated arrangement includes three stepping-motors 6*a*, 7*a*, 8*a*, which act on the stencil-frame 3 in a manner to move the same relative to the material 2.

The position of the material 2 and/or its printed pattern is, or are, evaluated with the aid of scanning and sensing devices, the illustrated embodiment incorporating, as before mentioned, two mutually identical sensing and scanning units 5, 5' which are located mutually opposite one another and are adapted to read-off a respective index mark.

Figure 5:
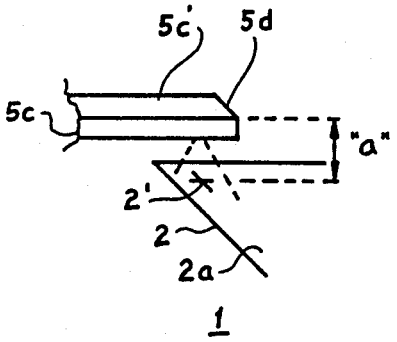
FIG. 5 illustrates the forward end of an arm carrying a scanning unit comprising a lens system for evaluating an index mark.

FIG. 5 illustrates schematically the arm 5*c*, and the sensing means in the form of lens system 5*d* firmly mounted thereon and connected to the camera 5*b* by means of a line intended therefor, these components comprising the aforesaid optical sensing unit 5, which can be displaced between the sensing or reading position illustrated in FIG. 1 to a withdrawn position externally of the printer. The arm 5*c* is intended to be inserted between the stencil 4 and the material 2 and to there sense or read an index mark or part of a previously applied pattern, and to then be retracted to its withdrawn position, in order to enable the pattern 4*b* to be printed on the material 2.

As indicated in FIG. 5, the lens is located on the free end 5*c'* of the arm 5*c* and is intended to read or scan an index mark 2' located on the material 2. This index mark is shown in FIG. 5 to have the form of a "+" although it will be understood that it may also have the form of a perforation or comprise part of an existing pattern. Although not shown, four optical fibres are arranged adjacent to the lens 5*d* in order to intensify the light in this region so as to facilitate the sensing or reading function of the lens.

Since the resolution of the lens system is dependent on the distance "a" between the lens 5*d* and the upper surface 2*a* of the material 2, it is possible that the camera system will discern the index mark "+" with different degrees of sharpness. The index mark "+" may also appear blurred at its defining edges.

Irrespective of whether the camera system and the camera discern the index mark exactly as it is or merely as a blurred contour, the position of the mark is nevertheless determined in relation to a specific point thereon, normally its centroid point.

The analogue signal produced by the camera 5*b* and characteristic of the image or figure read-off is transmitted to the control unit 14 and converted therein to a digital signal. The digital signal is then transmitted from the control unit 14, via the transmission line 17, signal converter 18 and transmission line 19 to the central unit 20, in which the centroid point of the index mark or the said part of said existing pattern is evaluated. The central control unit 20 is operative to construct the centroid point significant to the position of the index mark or the position of part of the existing pattern and to establish from this construction the x and y co-ordinates of the centroid point.

In order to enable this calculation to be carried out, it is necessary to convert the analogue signal to digital signals. Other conditions require the index mark to have a smaller surface area than a predetermined maximum area, a greater surface area than a predetermined minimum area and the area to have clearly defined and closed contours. These conditions are inserted into the software.

The central control unit 20 evaluates the signals received and calculates positional values relating to the position of the material 2, and from the results obtained produces control signals which are transmitted to respective stepping-motors 6*a*, 7*a*, via the stepping-motor control means 23 and the power supply means 21, so that the pattern 4*b* when printed will be located on the material 2 in the position desired with the smallest possible deviation from said desired position.

FIG. 3 illustrates a proposed constitutional block diagram for synchronised processing of two evaluated images of the index marks in relation to the working cycle of the printing machine, these images being received from a respective optical scanning and sensing unit 5, 5'.

The block "0" in the diagram signifies the idling mode of the printer. The block "1" signifies the mode adapted when the printer is operational and the material feed conveyor has been activated.

A waiting period is initiated in block "1", this waiting period continuing until the unit 5 or the lens system has been moved to its index-mark scanning position.

The block "2" signifies the mode in which the first unit 5 scans an allotted index mark. In this mode initiation of the memory 34 is effected by running a memory test. Synchronisation to the first line of the camera image, or frame, is then effected with the aid of information stored in the memory 34, and a waiting time is instigated for a period until all lines of the camera image or frame are scanned and stored.

The block "3" signifies the mode in which the second unit 5' scans an allotted index mark. As with the first unit 5 the memory 34 is first initiated by running a memory test. Synchronisation is then effected to the first line of the camera image or frame, with the aid of information stored in the memory 34, which delays until all lines of the camera image are scanned and stored.

Block "4" indicates the mode in which the x and y co-ordinates of the centroid point of the first image are calculated.

When these calculations are complete, the processor 30 switches to the mode signified by block "5" and calculates the x and y co-ordinates of the centroid point of the second camera image.

Block "6" signifies the mode in which the desired position of the frame 3 is evaluated in order to compensate for discrepancies between pertinent and evaluated centroid co-ordinates and desired centroid co-ordinates, and to establish the magnitude of the displacement required of the stepping-motors 6*a*, 7*a*, 8*a*.

The block "7" signifies the operational mode in which a cycle start is awaited subsequent to activation of the stepping-motors, whereupon the mode transfers to the block "1" mode.

The block "8" signifies an additional mode for error evaluation.

One possible error source is so-called "time out", which means that certain action must be taken within a given period of time, for example a working stroke shall be effected by the stepping-motors within a given time period determined by the programme. If the time period recorded in block "6" does not fall beneath this given time period, an error is indicated.

Another error source is one where a given operational sequence in a given block is not effected in accordance with the condition stipulated and/or the information received as a result thereof lies outside pre-determined limits. This applies to blocks "4" and "5".

A third error source lies in the peripheral units, such as the camera controlled means and the stepping-motor control means. The camera control means is monitored in blocks 2 and 3, whereas the stepping-motor control means is monitored in all blocks.

The working cycle of the printer is the controlling factor and monitoring is effected in a manner to synchronise the programme control function with the working cycle.

Thus, it can be mentioned that there is provided a read-error monitor for blocks "2" and "3", an image error monitor for blocks "4" and "5", a time monitor for indicating non-adjustment of the frame 3, a calculation error monitor for block "6" and a time monitor for return of the frame to given positional value.

Digital signals line for line with synchronisation to the first line are transmitted to the unit 34 over line 19 during each image read-out cycle.

The processor evaluates input signals by a processor bus 34*a* and restructures the signals and transfers to the memory 35 information. relating solely to status information, the number of transistions, and the positions on the line where the image passes from white to black and from black to white.

FIG. 4 illustrates the structure definition utilised for camera-data information to be stored in the secondary memory 35.

It can thus be established that a stored word relating to camera-data may have the following form and significance If it is assumed that a given line 41 on the image window shown in FIG. 6 shall be stored, the following camera data is given in the memory.

| STATUS | NO 2 | DATA 1 | DATA 2 |
|---|---|---|---|
| Where STATUS I NO 2 | indicates that line 41 is ready for processing; indicates that two mutually sequential words are present which refer to the information presented by the line; | | |
| DATA 1 | Indicates in digital form a word which with its most significant bit (O) establishes a change from white to black and thereafter the number (4) of white fields 42; | | |
| DATA 2 | indicates in digital form a word which with its most significant bit (1) establishes a change from black to white and thereafter the number (2) of black fields 43. | | |

STATUS 0, STATUS 2, STATUS 3, . . . etc to STATUS 6 indicate different error sources.

STATUS 9 on the other hand indicates the last line in the image line and also that the image is ready for processing with regard to its centroid point.

STATUS 9 also implies that all subsequent information belongs to the next image, which can be stored line for line in the aforesaid manner until the next following image has a line with the word STATUS 9.

The centroid point of the image is now calculated through the processor 30 in accordance with the mathematical rules applicable for the calculation of centroid co-ordinates in the direction of the x and y axes, with the aid of information stored in the memory 35.

This part of the programme, together with checking procedures for ascertaining that sufficient information is found for making the calculation are illustrated in FIG. 7.

This calculation of the centroid point must be related to the main directions allotted to the printing machine and to the material, restructuring of the thus calculated values being effected by that part of the programme illustrated in FIG. 8. Requisite restructuring of one of the co-ordinate directions is shown more clearly in FIG. 9.

Before the discrepancy relating to a stored value (40) for a desired image or index-position can be established, it is necessary first to establish this reference value.

This can be effected by applying a first print to a piece of material and evaluating the resultant positions of the x and y co-ordinates of the index marks printed thereon.

Figure 9:
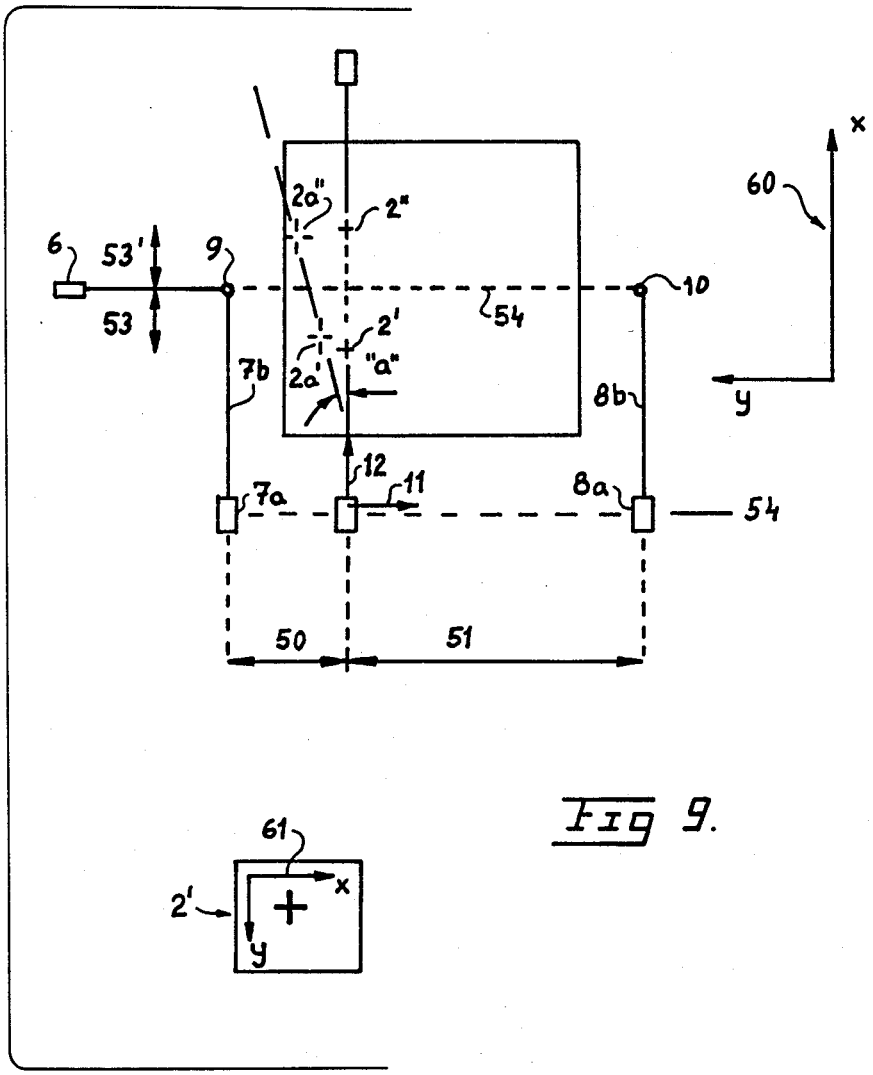
FIG. 9 illustrates schematically x and y co-ordinate relationships and a number of measurements for establishing the x and y co-ordinates of the centroid point of the index mark.

In order to make this possible it is necessary to obtain precise measurement data, of which the following can be mentioned with reference to FIG. 9.

The distance 50 between the arm attachment point 9 of the stepping-motor 7*a* and the pertinent camera position or pertinent reading position in relation to the index mark 2'.

The distance 51 between the reading position concerning the index mark 2' and the attachment point 10 of the arms 8*b* of the stepping motor 8*a*.

Although these distances may vary mutually, they are capable of being evaluated instantaneously with respect to the illustrated absolute coda 11.

The sum of the distances 50 and 51 is thus always constant.

The arm length 8*b* between the stepping-motor 8*a* and its engagement point 10 is identical with the arm length 7*b* between the stepping-motor 7*a* and the engagement point 9 and thus have an absolute equal distance.

Finally, the distance between the index mark 2' and a line 54 extending between the engagement points 9 and 10 is also of significance, this distance being referenced 53. The corresponding distance 53' is also a significant, and it will be understood that a corresponding distance with respect to the index mark 2'' shall also be evaluated.

The distance 53 is evaluated by the absolute coder 12.A calculation of a centroid point in accordance with the aforesaid conditions also applies to subsequent printing operations.

If it is found that the co-ordinates of the centroid point of the index marks are found to correspond exactly with the values previously stored, subsequent to introducing material to be printed into the the printing position and aligning said material in said position, the stepping-motors 6*a*, 7*a* and 8*a* are not activated.

When it is found that the material to be printed is correctly positioned with respect to the x and y co-ordinates but has travelled too far, solely the stepping-motor 6*a* is activated, whereas if the material is found to be displaced in parallelity upwardly or downwardly in FIG. 9, the stepping-motors 7*a* and 8*a* are activated.

The manner in which the stepping-motors 6*a*, 7*a* and 8*a* need to be regulated becomes more complicated, however, when it is found that the index marks are located obliquely in relation to one another, for example in the manner purposely exaggerated in FIG. 9 with misaligned index marks 2*a'* and 2*a''*.

The evaluation becomes even more complicated when it is necessary to take equal compensatory action because the index marks 2*a'* and 2'' are not only misaligned but that the distance between them is less than or greater than the distance between truly aligned index marks 2' and 2''.

In this latter case the processor 30 computes the positional values of the index marks 2*a* and 2*a''*, ascertains the number of pulses which need to be sent to each of the stepping-motors in the direction of the x-axis in order for the pressure generated to be correctly related and with the deviating distance equally compensated in relation to the true positions of the index marks 2' and 2''.

The presence of the x and y positions of the previous index marks 2' and 2'' and the x and y positions of the misaligned index marks 2*a'* and 2*a''*, make it possible to evaluate the angle "a", which defines the skewed position of the material.

It should first be established that a reference co-ordinate system 60 is located so that the material 2 is transported in the direction of the y-axis.

Scanning of the index mark is effected in a further co-ordinate system 61 which is twisted in relation to the co-ordinate system 60, requiring here a transposition or restructuring in accordance with the programme instruction illustrated in FIG. 8.

The print is placed centrally between the index marks with the programme instructions illustrated in FIG. 11.

The programme instructions illustrated in FIG. 12 are intended to evaluate solely the desired stepping-motor movement in the direction of the x-axis.

The programme instructions illustrated in FIG. 13 are intended for evaluation of the stepping-motor movements required to straighten a twisted print and to compensate for the angle "a" in FIG. 9.

The programme instructions illustrated in FIG. 14 are intended for evaluation solely of desired stepping-motor movements in the direction of the x-axis.

When the position of the engagement points 9 and 10 is known and position related to current index marks, the stepping-motors *6a*, *7a* and *8a* can be activated to compensate for the discrepancy.

It will be understood that the invention is not restricted to the illustrated and described embodiment, and that modifications can be made within the scope of the following claims.

I claim:

1. An arrangement in a silkscreen printer for positioning a second pattern deriving from a first pattern provided on a stencil in relation to material to be printed while using a first memory means adapted to store the desired print position of the second pattern in relation to a reference point, the material to be printed being displaceable into a printing station, the said arrangement including means for evaluating the true position of the material in the printing station, and means for evaluating any discrepancy which might occur between the actual and the desired print locations on said material if the second pattern were to be applied thereto with the material in its present position in said station and to evaluate any discrepancy between the actual position and the desired position, the arrangement including further means which, in the event of a discrepancy between said actual and desired print positions, are operative to displace a frame carrying the stencil and/or a printing table and/or the material to a position contingent on the magnitude and directional sense of the discrepancy, or to bring the same to said position in some other way, such that when applying the second pattern to the material, the second pattern is printed in a position on said material in which the previously established discrepancy is fully or satisfactorily compensated, evaluation of the position of the material being made possible with the aid of index marks or part of a previously printed pattern, characterized in that the stencil frame (and/or the material) are arranged for displacement by means of three stepping-motors or like devices; and in that signals corresponding to the evaluated and calculated displacement values for each of the stepping-motors are transmitted thereto so that the pattern, when printed will be located on the material in the position desired with the smallest possible and/or essentially smallest possible deviation form said desired position.

2. An arrangement according to claim 1, characterised in that the position of the material and/or the pattern is, or are, evaluated by means of one or more optical scanning and sensing means, preferably arranged to evaluate the position of index marks; in that the scan signal from the optical scanning and sensing means are transmitted to a first unit (34) for storing scan signals for each line in real time; and in that the arrangement further comprises a processor (30) which evaluates the said scan signals and restructures the signals for storage in a second memory (35).

3. An arrangement according to claim 1, characterised in that restructuring involves transferring to the second memory (35) information which solely comprises status information and the number of transitions and the locations at which the image transfers from white to black and from black to white.

4. An arrangement according to claim 1 characterised in that the scan signals for a complete image or frame from a first optical sensing and scanning unit are first fed to the unit (34) and then restructured for storage in the second memory, whereafter scan signals for a complete image or frame from a second optical scanning and sensing unit are first fed to the unit (34) and thereafter restructured for storage in the second memory.

5. An arrangement according to claim 1, characterised in that the first memory and the second memory are integrated in one another.

6. An arrangement according to claim 1, characterised in that optical fibres are arranged adjacent to the optical scanning and sensing means for illuminating the index mark.

7. an arrangement according to claim 1, characterised in that the index mark is arranged to be evaluated by the optical scanning and sensing means over a surface area which is smaller than a predetermined maximal surface area, over a surface area which is larger than a predetermined minimum surface area and over a clearly defined contour in order to be accepted for calculation of the x and y co-ordinates of the centroid point.

8. An arrangement according to claim 1, characterised in that the image or frame obtained from the optical scanning and sensing means is restructured to orient the x and y co-ordinates in relation to a reference co-ordinates in relation to a reference co-ordinate system.

9. An arrangement according to claim 1, characterised in that a programme instruction is provided for establishing stepping movement of the motors in the direction of the x-axis, a programme instruction for establishing stepping movement of the motors in the direction of the y-axis, and a programming instruction for establishing combined stepping movements of the motors for effecting rotational movement.

10. An arrangement according to claim 9, characterised in that the evaluated stepping movements of the stepping-motors are added and supplied simultaneously to the stepping-motors for simultaneous displacement movement.

* * * * *